US005170101A

United States Patent [19]

Gorski et al.

[11] Patent Number: 5,170,101

[45] Date of Patent: Dec. 8, 1992

[54] CONSTANT HORIZONTAL DIMENSION SYMMETRICAL BEAM IN-LINE ELECTRON GUN

[75] Inventors: Richard M. Gorski, Arlington Heights; Eugene A. Babicz, Evanston, both of Ill.

[73] Assignee: Zenith Electronics Corporation, Glenview, Ill.

[21] Appl. No.: 815,739

[22] Filed: Dec. 30, 1991

[51] Int. Cl.[5] ..... H01J 29/51; H01J 29/50; H01J 29/70

[52] U.S. Cl. ..... 315/368.11; 315/368.15; 313/412; 313/428

[58] Field of Search ..... 315/368.11, 368.15, 315/368.16, 382; 313/412, 428

[56] References Cited

U.S. PATENT DOCUMENTS

| | | | |
|---|---|---|---|
| 4,388,552 | 6/1983 | Greninger | 313/414 |
| 4,701,677 | 10/1987 | Ashizaki et al. | 315/382 |
| 4,800,318 | 1/1989 | Naiki | 313/414 |
| 4,967,120 | 10/1990 | Katsuma et al. | 315/382 |
| 5,017,843 | 5/1991 | Barten | 313/412 |

OTHER PUBLICATIONS

"A New Picture-Tube System With Homogenous Spot Performance", Gerritsen et al., Proceedings of the SID, vol. 31/3, pp. 179-183, 1990.

"An In-Line Color CRT With Dynamic Beam Shaping For Data Display", Yamane et al., Proceedings of the SID, vol. 29/1, pp. 41-45, 1988.

"Progressive-Scanned 33"110° Flat-Square Color CRT", Suzuki et al, Proceedings of the SID, vol. 28/4, pp. 403-407, 1987.

"In-Line Gun With Dynamic Astigmatism and Focus Correction" Ashizaki et al, Proceedings of the SID, vol. 29/1, pp. 33-39, 1988.

*Primary Examiner*—Gregory C. Issing

*Attorney, Agent, or Firm*—Roland W. Norris

[57] ABSTRACT

A three beam, in-line, color CRT electron gun is disclosed for use in high resolution tubes with self convergent yokes. The dynamic quadrupole and main lenses of the gun are complementary to provide emitted beams that are radially symmetrical and of like size and shape, and of constant horizontal dimension and focal length throughout the deflection cycle, thus letting the yoke provide for the correct beam focus upon deflection. Vertical emitted-beam dimension is balanced against the yoke compressive force and the increased deflected beam throw distance to provide well-controlled spot sizes.

13 Claims, 8 Drawing Sheets

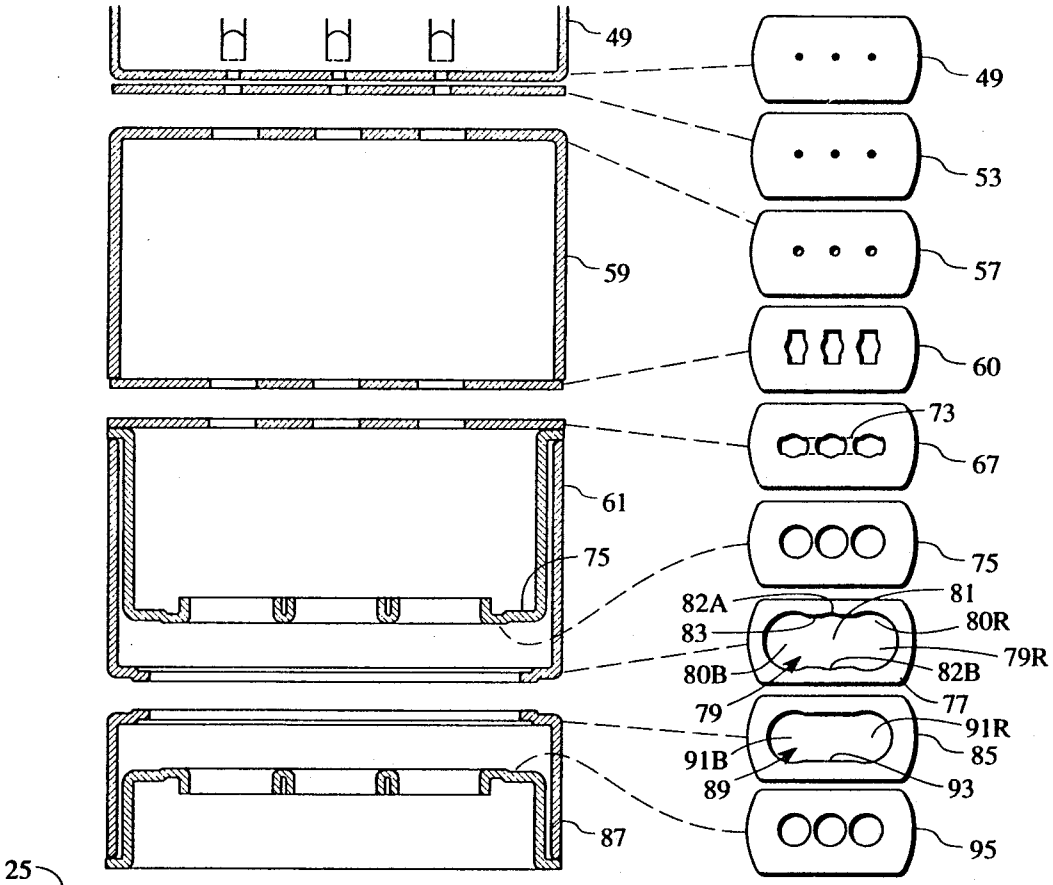
Fig. 8
Fig. 7
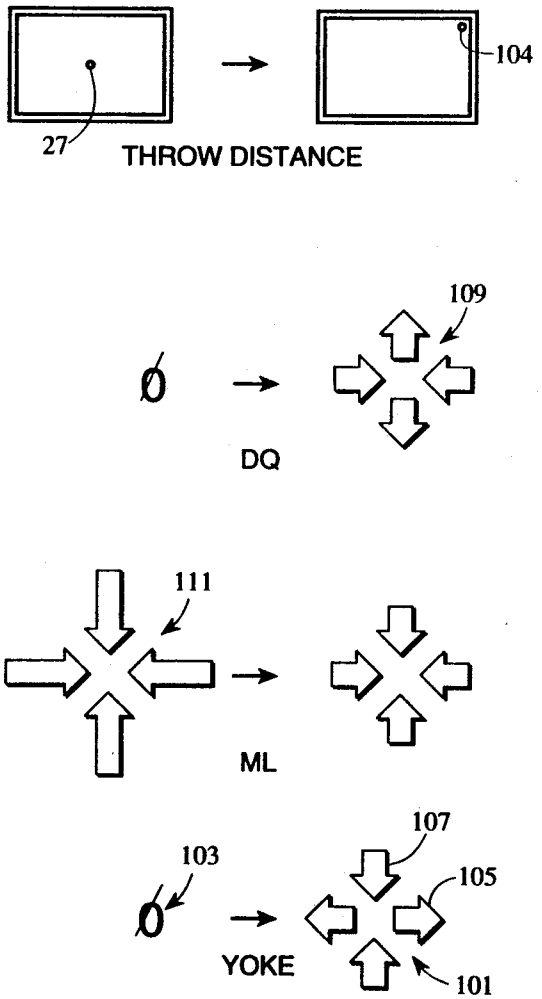
Fig. 9

=

≠

CONSTANT HORIZONTAL DIMENSION SYMMETRICAL BEAM IN-LINE ELECTRON GUN

BACKGROUND OF THE INVENTION

1. Field of the Invention

The present invention relates generally to electron guns for cathode ray tubes (CRTs). The present invention relates more particularly to electron guns suitable for use with self-converging (SC) deflection yokes in high resolution color CRTs.

2. Discussion of the Related Art

Terminology

The following terminology is set forth as an aid to understanding the application. "Beam" or "beam bundle" refers to a single cohesive electron stream formed from one cathode. An "emitted-beam" refers to the electron beam as it leaves, or is emitted from, the electron gun. A beam may be "compressed" or "diffused", i.e., the electrons therein may be subject to greater cohesion or dispersal. Each beam has an optimal "focus" to produce an optimal "spot" size, i.e., cross section of the beam, on the screen, or image plane. At a particular "throw distance length", i.e., distance from the gun to a particular point on the screen. A "focal length" is is a property of a lens meaning the distance from the lens to the point where the beam is focused. Focal length is, of course, controlled by the particular characteristics of the lens. The lens characteristics in an electro-optic system, such as found in a CRT electron gun, are dependent upon the voltages applied to the gun at a given time. An unfocused beam may be "under-focused", i.e., the beam has not compressed sufficiently before reaching the screen; or "over-focused", i.e., the beam has compressed before reaching the screen and has begun to spread again by the time it reaches the screen. A beam may be focused in the vertical direction and unfocused in the horizontal direction, or vice-versa, at the same point in space.

The above terms relate to an individual beam. However, in multiple beam guns, the beams, or beam group, must be coincident at all points on the screen, or properly "converged". In most instances however, the beams must be "diverged" from their static paths set by the physical structure of the gun in order to be coincident, or properly "converged", on the screen. A beam group not properly converged may be "over-converged" to a point of coincidence short of the screen or "under-converged" to a point of coincidence beyond the screen. Thus, in referring herein to a single beam only its path may be changed by divergence or convergence factors, while only its shape may be changed by compressive or diffusive factors, even though both sets of factors may be caused by the same piece of equipment, e.g., the yoke.

As is known and shown in FIG. 1, a color CRT 11 forms an image by scanning three electron beams 13R, 13G, 13B, across a phosphor screen 15 to excite discrete deposits of red, green, and blue light-emitting phosphors (not discretely shown) comprising the screen 15. By proper alignment and positioning with the phosphor screen a shadow mask 17, is used to transmit the beams 13R, 13G, 13B to their intended phosphor targets, while blocking the undesired beams from landing on the improper phosphor dots. Certain other necessary components of an operational CRT will not be discussed in the aid of clarity for this disclosure, but will be understood to be present. The electron beams 13R,G,B (collectively Ref. No. 13) are formed in, accelerated, shaped and emitted from an electron gun 19 located at a first, cathode end 21 of the tube 11 in the neck 23 of the tube. The beams 13 are then scanned across the screen 15 by deflection yoke 25.

FOCUS

An electron beam is a bundle of electrons, which must be focused from an electron cloud, emitted from a cathode in the electron gun, to a narrow conical beam causing a bright spot to occur on the screen. The beam spot should be of a size closely related in area to the phosphor deposits; screen pitch and image resolution. Thus, a beam must be focused to a particular cross-sectional size at a particular throw distance, i.e., the electron gun 19 and yoke 25 must be electrically controlled to achieve the proper focal length. However, a problem in tube design arises. Referring to FIG. 2, if one thinks of the beam bundle 14 as a cone 24 pointing at the desired area, e.g. center screen 27, the self-converging yoke's properties will cause the cone point 29 to trace a parabolic arc 30 as it is deflected. Unfortunately, CRT screens do not form the same parabolic arcs. They are increasingly flat 26 or curved in larger radius 28 than the arc 30 of the cone.

Thus, the cone 24, or beam 14, will not retain the same focus at different throw distances. Referring also to FIG. 3, the beam 14 will be over-focused 31 if the cone point falls short of the screen 15 and begins to expand again, or under-focused 33 if the cone point focuses beyond the plane of the screen 15. Either of these conditions results in a too-large spot size 35 which degrades the image. Typically, the beam bundle 14 is focused at screen center 27 and then must be diffused to maintain proper focus (i.e., spot size) as the beam is deflected away from center screen to longer throw distances at the screen corners. If not diffused, deflection would result in an over-focused condition for the beam.

CONVERGENCE

The three beams 13R, 13G, 13B, must form a beam group coincident at the screen 15 for proper image formation. Each beam in the group must still be individually focused also.

As seen in FIG. 5, just as an individual beam 14 must change its focus when the beam is deflected and its throw distance changes, so too must the convergence angles 16, 18 be adjusted between the outer beams 13R, 13B and the central beam 13G in order to keep the beams coincident as they are collectively deflected across the screen 15. This beam spreading task is now most commonly performed in the operational CRT 11 (FIG.1) by a yoke 25 of the self-converging type which has electrical windings configured to adjust the yoke deflection fields and diverge the outer beams 13R, 13B to keep the beam group 13 coincident, or converged, at the screen 15 during beam scanning. But, the self-converging yoke field has the unintended side effect of distorting the shape of the individual beams 14 as they pass through the yoke's magnetic field. This results in an astigmatic beam spot 32 (FIG. 4) at the screen corners having an overfocused vertical dimension resulting in a halo 34, and an underfocused horizontal dimension resulting in a core 36 having its long axis tipped slightly toward center screen 27.

In order to counter the effects of the self-converging yoke field, dynamic lenses typically of the dynamic quadrupole (DQ) type, have been put into electron guns to shape the beams with a field opposite in effect to the yoke field. However, the beams shaped by the dynamic quadrupole lens are still subject to the distortional forces of the main lens within the gun. Schemes for balancing the dynamic and main lens of the gun to counter the distortional effects of the self-converging yoke field have been proposed in the art. See, e.g. Katsuma et al, U.S. Pat. No. 4,967,120; Ashizaki et al, In-Line Gun with Dynamic Astigmation and Focus Correction, *Proceedinqs of the SID*: Vol. 29/1, 33, 1988. It has been determined by the applicant, however, that in order to obtain optimal control of the spot size, and therefore, image resolution, that all the beams emitted from the gun in this type of system must be radially symmetrical and of like size and shape. Lens structures have been proposed to maintain all emitted beams in like size and shape, see, e.g. Naiki, U.S. Pat. No. 4,800,318; but to the knowledge of the applicant, there is no teaching to combine a balanced dynamic quadrupole (DQ) and a symmetrical beam main lens (ML) system to create a gun having a synergy from both systems for optimal spot size throughout the deflection range of the beams. Thus, what is called for is a gun which emits all three beams shaped to ultimately be radially symmetric, of like size and shape, and focused to the optimal spot size after undergoing the yoke distortional forces and focal length changes imposed on the deflected beams.

Other references of interest may include:

Suzuki, et al., Progressive-Scanned 33"110 ° Flat-Square Color CRT, *Proceedinqs of the SID,* Vol: 28/4, 403, 1987; Yamane, et al., An In-Line Color CRT with Dynamic Beam Shaping for Data Display, *Proceedings of the SID,* Vol 29/1, 41, 1988; Gerritsen, et al., A New Picture-Tube System with Homogenous Spot Performance, *Proceedings of the SID,* Vol. 31/3, 179, 1990; Greninger, U.S. Pat. No. 4,388,552.

The foregoing patents provide varying contributions to the cathode-ray tube art, which in themselves are valuable, but the patents do not suggest how the varying concepts disclosed therein can be combined to obtain an electron gun having the improved performance characteristics of the present system.

OBJECTS OF THE INVENTION

It is an object of the invention to provide an electron gun which emits electron beams of optimal size and shape for their given conditions within the tube.

It is a further object of the invention to provide an electron gun whose dynamic quadrupole (DQ) lens and main lens fields are complimentarily balanced to emit radially symmetrical electron beams of like size and shape which are formed to optimal size and shape after passing through a self-converging yoke magnetic field.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

FIG. 7 is a cross sectional view of the preferred embodiment;

FIG. 8 is a front view of the component aperture plates of the preferred embodiment;

FIG. 9 is a diagram of the beam shaping forces within the CRT at proper operating voltages;

DESCRIPTION OF THE PREFERRED EMBODIMENT

The preferred embodiment is described with respect to a gun suitable for use in a 15 or 17 inch flat tension mask monitor of, for example, 1024×768 line resolution. The reader should bear in mind that such terms as "radially symmetrical" and "like size and shape" are expressed relative to the vagaries of the CRT operating environment and represent optimization of the beam structures and not absolutes.

Figure 6:
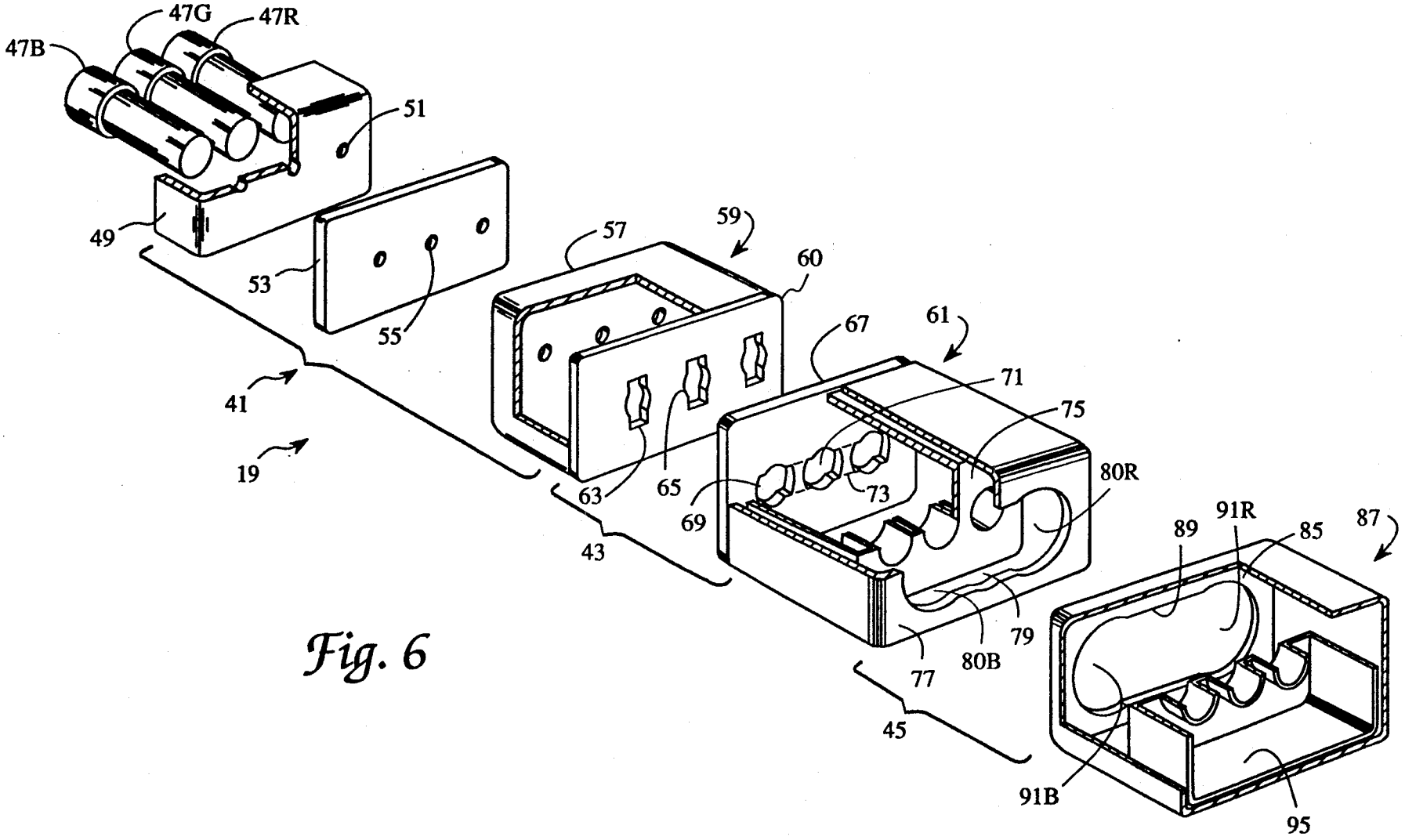
FIG. 6 is a perspective of gun components according to the preferred embodiment.

As seen in FIGS. 6,7, and 8, the preferred embodiment of the present invention is illustrated in the context of an in-line electron gun 19 having a beam forming region 41, a dynamic quadrupole lens 43 and an expanded field main lens 45.

Figure 1:
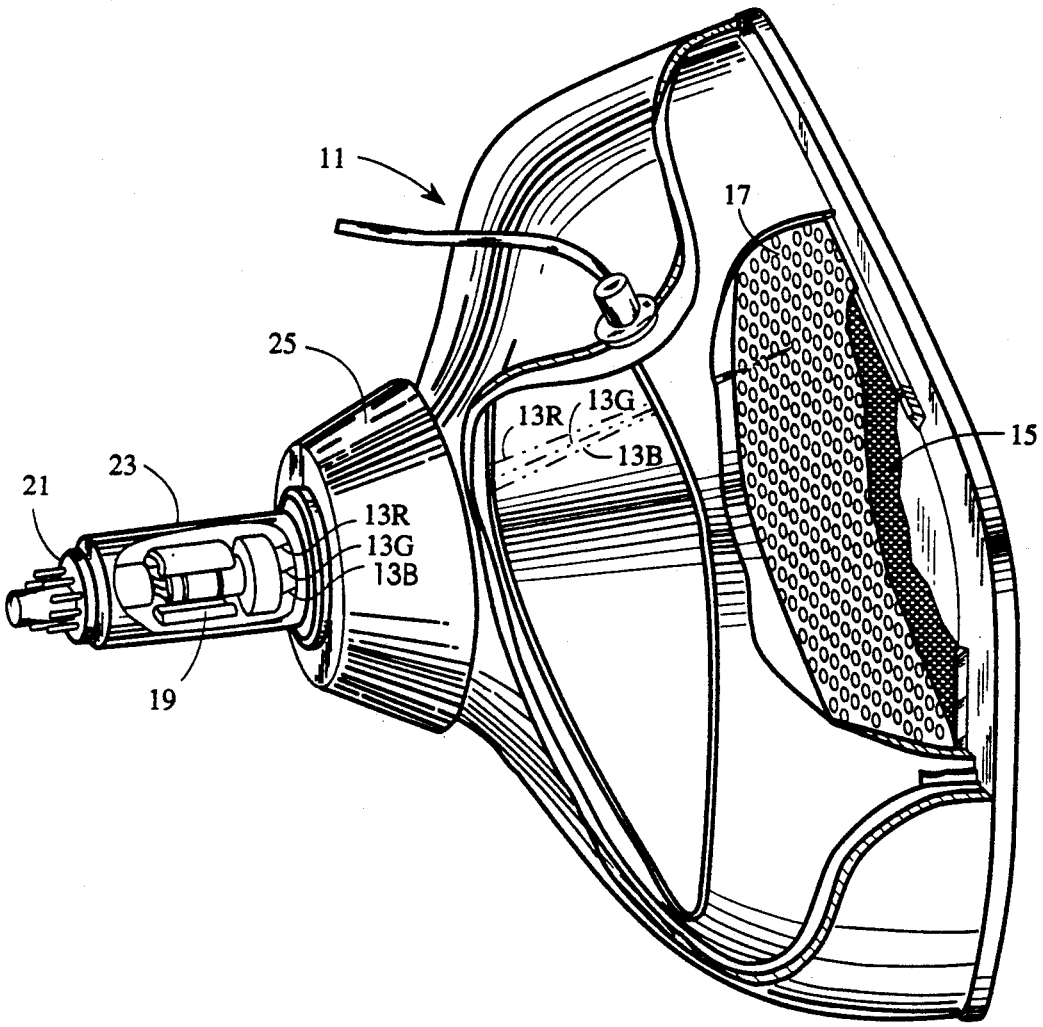
FIG. 1 is a partially cut-away perspective view of a flat tensioned mask CRT.
Figure 2:
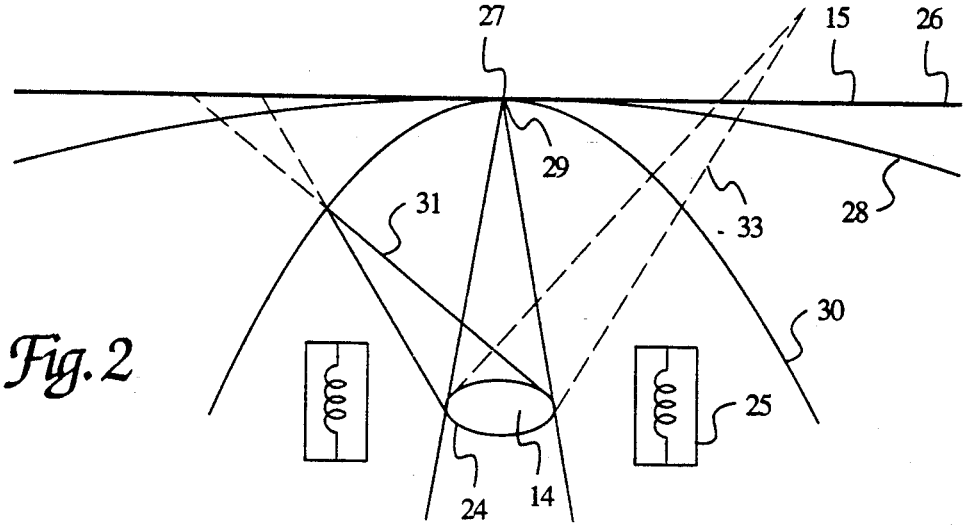
FIG. 2 is a diagram of beam focus deflection problems associated with changing throw distances.
Figure 3:
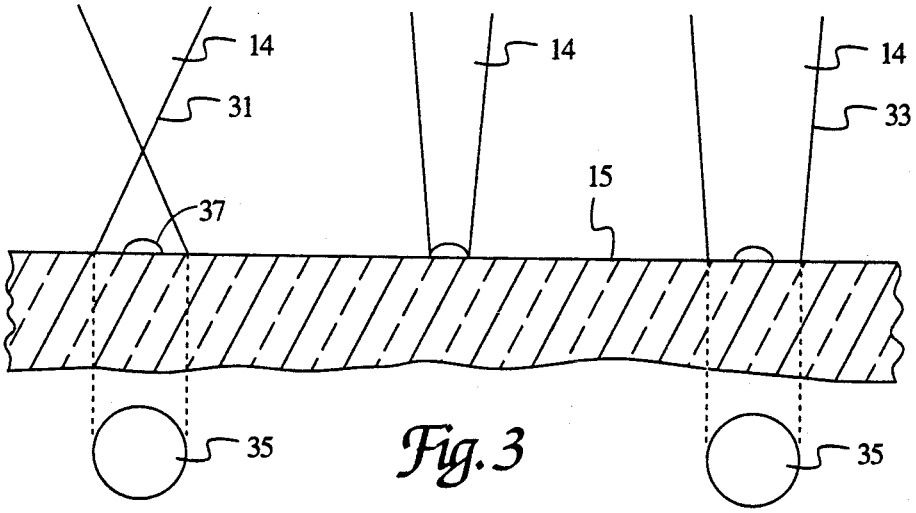
FIG. 3 is an enlarged detail view of FIG. 2.
Figure 4:
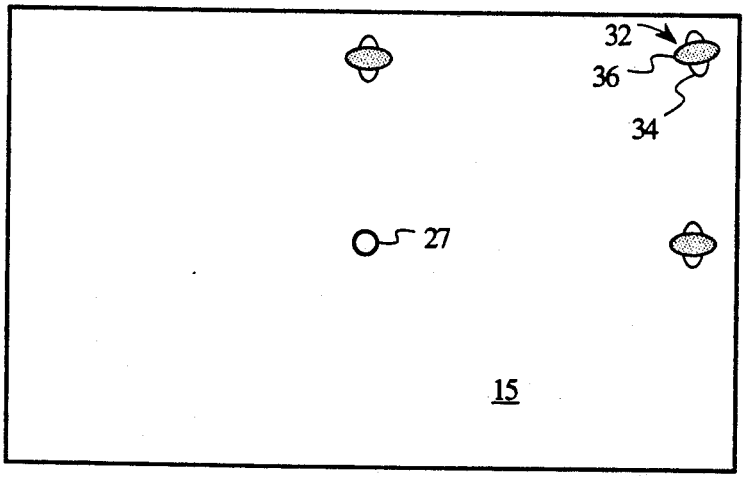
FIG. 4 is a front view of a CRT screen illustrating beam focus problems.
Figure 5:
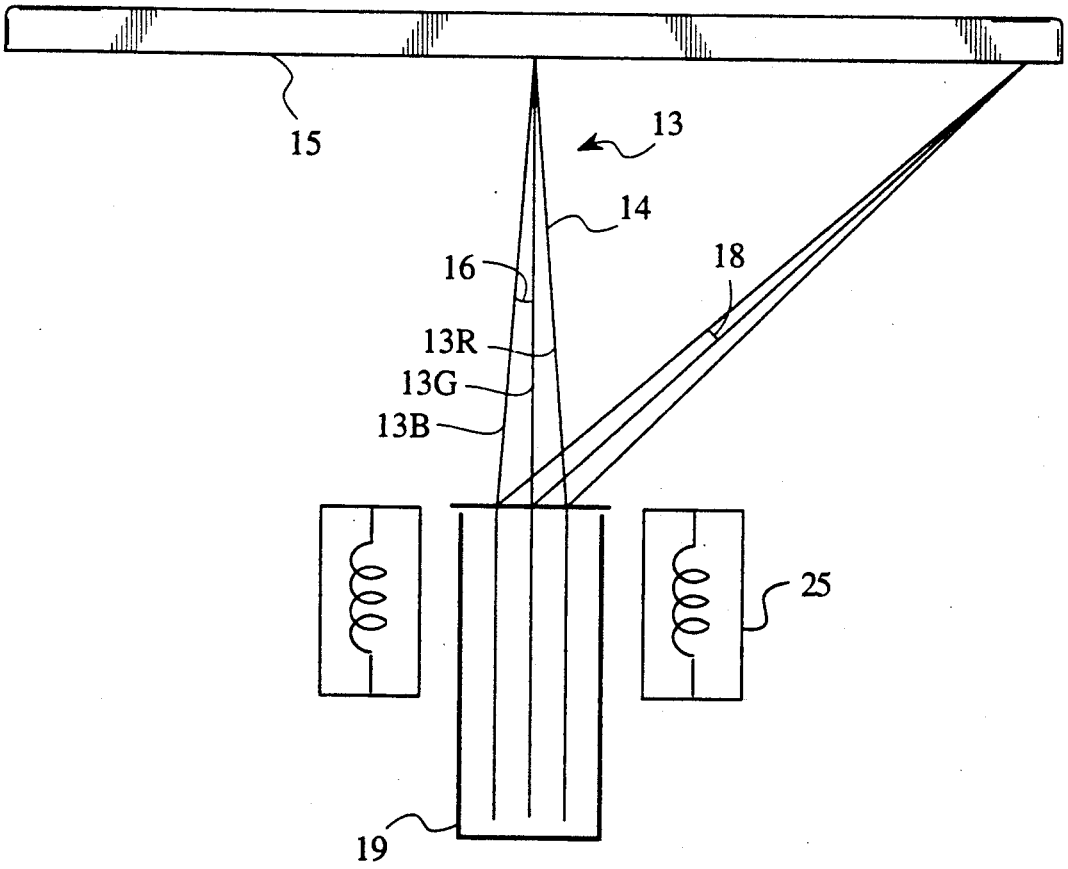
FIG. 5 is a diagram of beam convergence problems associated with beam deflection.

The beam forming region 41 located at the rearmost, or lower, end of the gun 19 comprises three horizontally in-line dispenser cathodes 47R, 47G, 47B providing long cathode life at high beam current density. The cathodes, 47 collectively, are surrounded by a control grid, G1, 49 four mils thick and having three fourteen mil diameter apertures, 51 collectively, for initially forming each electron beam 13 (FIG. 1). The first accelerating grid, G2, 53 is separated from G1 49 by six mils and has three eighteen mil diameter apertures, 55 collectively, axially aligned with the G1 apertures 51 for further defining the electron beams 13. The lower aperture plate 57 of the third grid, G3, 59 is separated from G2 by forty mils and located on the lower side of the focus electrode, G3, 59. The G3 lower aperture plate 57 has discrete apertures axially aligned with G1 and G2 apertures and completes the beam forming region 41.

The dynamic quadrupole (DQ) lens 43 is formed between the G3 lower 59 and G3 upper 61 electrodes, or barrels, which are substantially barrel shaped. The G3 lower barrel 59 has located at its upper end a "keyhole" aperture plate 60 having three horizontally in-line and vertically elongated rectangular apertures, 63 collectively, for quadrupole field formation with centrally located circular cut outs, 65 collectively, to aid in mandrelling during gun construction without adversely affecting beam divergence and appropriate beam shaping against the forces of the self-converging yoke 25

(FIG. 1) field. These apertures 63 are commonly called "keyhole" apertures, this nomenclature being derived from their overall shape. The keyhole plate 60 is also denominated as the lower DQ plate. In the preferred embodiment, the vertically elongated rectangular apertures measure 180 mils vertical by 85 mils horizontal with the central circular cutouts 65 having a diameter of 120 mils. These apertures 63 have a center-to-center, or "S", spacing of 200 mils. The apertures 63 are axially aligned with the collared aperture plate 57 apertures. The keyhole plate 60 is 15 mils thick. The G3 lower electrode receives a fixed voltage of approximately seven and one-half Kilovolts. Completing the DQ lens structure 43 is a "razor blade" plate 67 facing the keyhole plate 60 and located on the lower end of the G3 upper barrel 61. The razor blade plate 67 has horizontally elongated rectangular apertures 69 having central circular cutouts 71. The "razor blade" nomenclature is derived from this plate's resemblance to the double-edged safety razor blades formerly common in the U. S. The razor blade with a 200 mil "S" spacing horizontal aperture 69 measure 160 mils horizontal by 85 mils vertical with a 200 mil "S" spacing. The circular cutouts have a diameter of 120 mils. The razor blade apertures 69 are made discontinuous to aid in grid manufacture. Alternatively, the discrete apertures shown in FIG. 6, may be interconnected with a single horizontal channel, as indicated by dashed lines 73, without adversely affecting lens characteristics. A dynamic voltage of about seven and one-half to eight kilovolts which varies with beam deflection is applied to the G3 upper grid 61.

The main lens 45 comprises, from the lower end, a second collared aperture plate 75 within the G3 upper barrel 61, a "chain-link" aperture plate 77 covering the upper end of the G3 upper barrel, a "dog bone" aperture plate 85 covering the lower end of the anode electrode, G4, barrel 87, and a third collared-aperture plate 95 covering the upper end of the G4 barrel. The G4 grid is supplied with a fixed voltage of approximately twenty-five or thirty kilovolts. The chain-link aperture plate 77 of the present invention was created to obtain the desired balanced lens characteristics, discussed below, when balanced against the dog bone aperture plate 85, which shape is known in the art. The second and third collared aperture plates 75, 95, respectively, are added to aid in controlling the outer beam 13R, 13B symmetry with the central beam 13G.

The main lens construction in detail, is as follows. A second collared-aperture plate 75 is located within the G3 upper barrel 61 one hundred mils from the chain link aperture 77 to help maintain beam focus and symmetry between the outer and central beams. Each aperture has a one hundred sixty mil diameter with 200 mil center or "S" spacing. The "chain-link" aperture plate 77 covers the upper end of the G3 upper barrel 61. The chain-link opening 79 is an expanded field opening in which the beam apertures are interconnected to make a larger lens, minimizing spherical aberrations. The chain-link opening measures seven hundred twelve mils horizontal with opposed, substantially "D"-shaped outer beam apertures 80R, 80B radiused at one hundred fifty-six mils and a central beam aperture 81 radiused at one hundred fifty-one and one half mils. The slight protrusions **82*a*, 82*b* created by radiusing the central aperture 81 help to maintain the central beam in like size and shape with the outer beams. A central flat-sided channel 83 connects the apertures and measures two hundred eighty and one half mils vertical. "S"-spacing is two hundred mils thus giving the outline appearance of a bicycle chain-link or a centrally banded gelatin capsule having bulbous ends whose diameters exceed that of the central band. The chain link plate 77** itself is fifteen mils thick.

A "dog bone" aperture plate 85 forms part of the main lens 45, and faces the chain-link plate 77 and covers the lower end of the acceleration electrode, or anode, G4, 87. The "dog bone" opening 89 forms an expanded field opening and measures seven hundred twelve mils horizontal with outer beam apertures 91R, 91B radius at one hundred forty-seven mils connected by a flat sided central channel 93 measuring two hundred sixty-four mils vertical. "S"-spacing is two hundred nine mils thus, giving the opening an outline appearance of a bone given to dogs or a dumbbell with a thick center shaft. The increased "S" spacing in the dog bone opening 89 provides a static convergence in the main lens to refract the outer beam 13R, 13B towards the center beam 13G (FIG. 1). A third collared-aperture plate 95, of the same dimensions as the second collared aperture plate 75, completes the main lens 45, and is located in the upper end of the G4 barrel one hundred mils from the dog bone and likewise serving to maintain outer beam radial symmetry. It is possible to vary the shape of the collared-aperture plate apertures to attain greater regularity of size, shape, and symmetry among the beams if necessary. The G4 electrode has a fixed anode voltage of approximately twenty-eight Kilovolts.

The structure of the preferred embodiment was designed to enable the gun 19 to emit beams 13R, 13G, 13B which are balanced against both the distortional effects of the self-converging yoke 25 field and the under-focusing effects of increasing focal lengths. The beams, according to the present invention are vertically expanded, or positively astigmatic, with increased deflection while retaining a constant horizontal dimension.

Referring to FIG. 9, the self-converging component of the yoke field 101 can be seen to have a field ranging from no effect 103 on beams at center screen 27 to a horizontal diffusion force component 105 and vertical compression force component 107 upon the deflected beams 104. The self-converging yoke is a practical necessity in most in-line gun CRTs and especially in flat screen tubes 11 (FIG. 1) where beam throw distance changes are most extreme over the beam deflection range. Therefore, the gun 19 must have a DQ lens 43 to provide a counter-balancing force 109 opposite in direction to that of the yoke force 101. But, the main lens (ML) 45 also exerts a force 111 shaping the beams subsequent to the DQ lens 43. The ML force 111 is constantly compressive in both horizontal and vertical directions. But, in relative terms, the beam will expand when the main lens force grows smaller. This happens upon beam deflection, as the dynamic voltage of G3 upper rises and lessens the potential between G3 upper and G4.

Figure 10A:
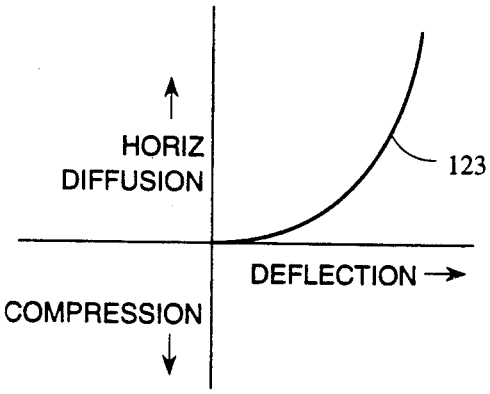
FIGS. 10A–F are graphs illustrating the balance of forces required of the present invention in a self-converging yoke CRT.
Figure 10B:
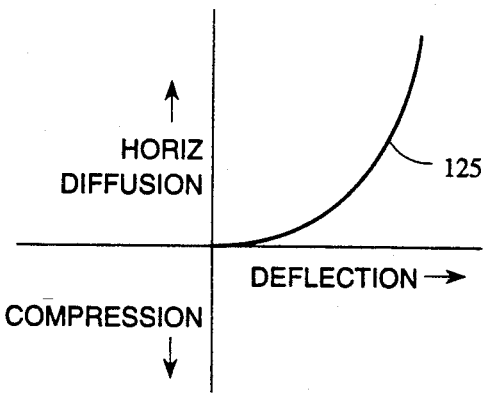

It will be remembered that the beam bundle must be diffused upon deflection from center screen to compensate for the over-focusing effect from increased throw distance. Parabolic arc 123 of FIG. 10A shows the amount of beam diffusion required in the horizontal plane to compensate for the over-focusing effect and maintain the beam horizontal focal length properly on the screen. The parabolic arc 125 of FIG. 10B shows the horizontal beam diffusion provided by the self converging yoke's horizontal diffusive force 105 (FIG. 9). As can be seen, the self-converging yoke horizontal diffusive force 105 is acting in the correct direction, and it is not necessary for the gun to change the focus of the emitted beam in the horizontal plane. Therefore, it can be seen that an emitted beam having constant horizontal focus will experience horizontal diffusive yoke forces that will increase the beam's horizontal focal length in proportion to deflection. In effect, the yoke field will focus the deflected beam in the horizontal plane.

Figure 10C:
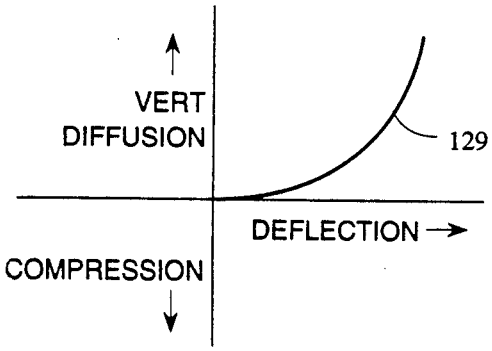
Figure 10D:
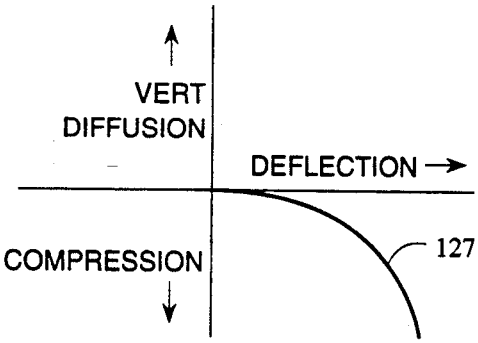

As seen in FIG. 10C, as was the case in the horizontal plane, the increasing throw distance with deflection requires diffusion of the beam in the vertical plane to maintain vertical focal length properly on the screen. Parabolic arc 129 of FIG. 10C shows the amount of vertical diffusion required to maintain focus on the screen. However, the vertical yoke forces 107 (FIG. 9) are acting to compress the emitted beam upon deflection, as represented in FIG. 10D by parabolic line 127 of substantially equal but opposite slope. The self-converging yoke vertical compressive force 107 (FIG. 9) is acting in the wrong direction and effectively shortening the beam's vertical focal length. The gun must then emit a beam bundle which is increasingly vertically diffused throughout the deflection range to overcome the increasing vertical compressive force 107 of the yoke field 101 in order to maintain proper vertical focus in proportion to deflection.

Figure 10E:
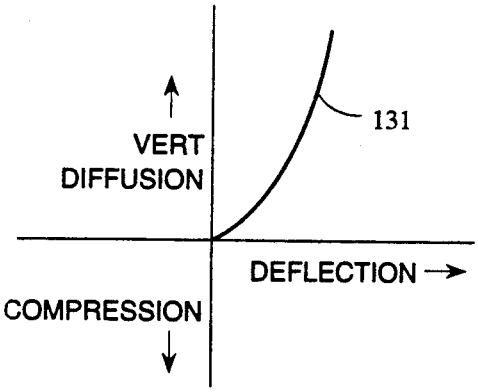

As seen in FIG. 10E, in the vertical plane, the gun must counter not only the vertical compressive yoke forces but must also counter the over-focusing effect from increased throw distance upon beam deflection. Therefore, the gun must provide a large amount of diffusion for the emitted beam in the vertical plane as represented by the steeply sloping parabolic line 131.

Figure 10F:
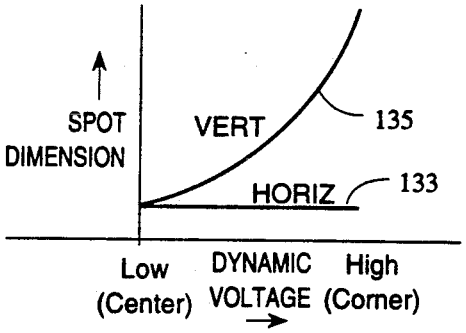

As shown in FIG. 10F, the preferred embodiment is constructed and arranged so that the DQ horizontal compressive-force and main lens horizontal diffusive forces are complimentarily balanced to achieve a constant horizontal beam dimension 133 which the self-converging yoke can then diffuse to the proper focus as the deflection increases. Further, as deflection increases, the DQ lens vertical diffusive force is additive with the reduction in main lens vertical compressive force to produce a vertical beam dimension 135 and vertical focal length which greatly increase with deflection, and which the self-converging yoke can then compress to the proper focus as the deflection increases. Further, the main lens structure is arranged to provide radially symmetrical beams of like size and shape because it has been empirically found to result in maximum control of each beam's spot size.

Figure 11:
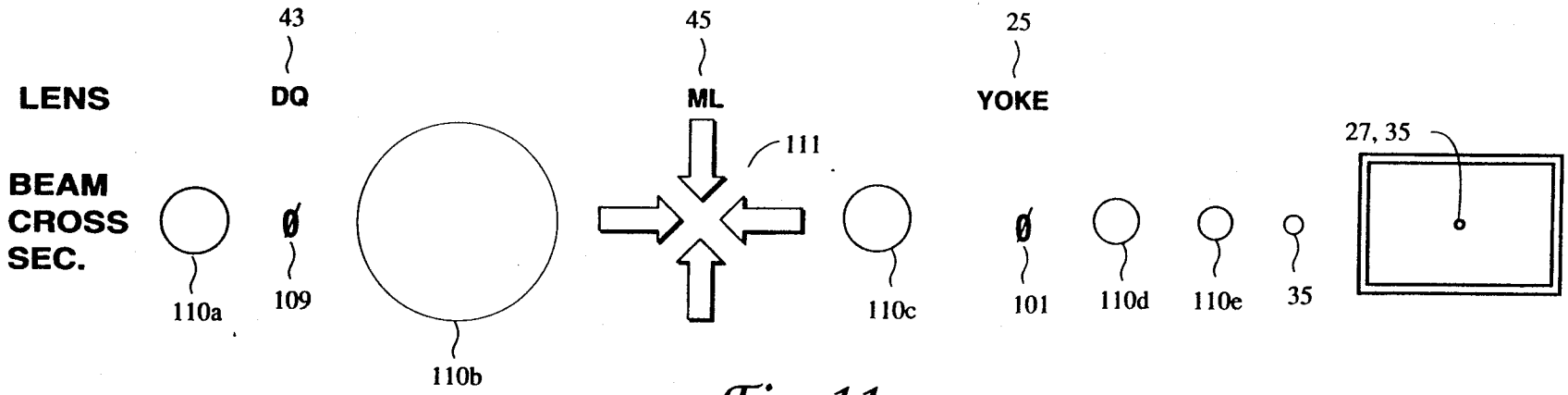
FIG. 11 illustrates beam bundle deformation within the CRT at center screen.

Referring to FIG. 11, ie., at center screen 27 beam position, the DQ lens 43 is inactive 109, the main lens 45 exerts its greatest compressive force 111, and the yoke 25 is inactive 101. The beam bundle is focused to its optimal spot size 35. No dynamic voltage is applied to G3 upper, so that the DQ lens potential is zero and the main lens potential is maximum. Cross-sections **110*a*–110*g* of an undeflected beam are shown as they appear along the beam path: on exit 110*a* from the beam forming region, on exit 110*b* from the inactive DQ lens 43 here seen expanding betweens the DQ lens 43 and the main lens 45, upon exit 110*c* from the main lens 45 here seen narrowing between the main lens 45 and the inactive yoke 25, upon exit 110*d* from the yoke field, upon further narrowing 110*e* between the yoke and screen, and the spot size 35 upon reaching the screen 15. The beam cross sections 110A–110*e*** are circular throughout the path. In actuality, the main lens of the preferred embodiment has a slight positive astigmatism at center screen position. A small negative astigmatic force is applied to the beam with the DQ lens which will cancel the positive astigmatism o the main lens and result in a round beam exiting the gun.

Figure 12:
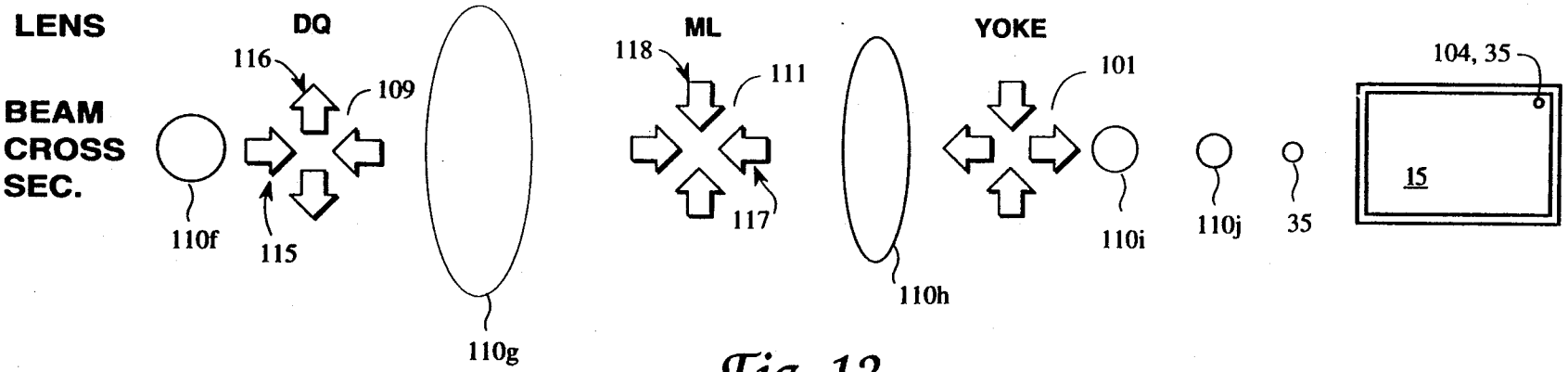
FIG. 12 illustrates beam bundle deformation within the CRT at corner screen.

Referring to FIG. 12, the beam is deflected to the screen corner 104. Cross-sections **110*f*–110*j* of the deflected beam are shown in the manner of FIG. 11 as they appear along the beam path: on exit 110*f* from the beam forming region, on exit 110*g* from the active DQ lens seen as expanding between the DQ lens and main lens, upon exit 110*h* from the main lens seen as narrowing between the main lens and yoke, upon exit 110*i* from the active yoke field, and upon further narrowing 110*j* between the yoke and screen, and the spot size 35 upon reaching the screen. Here, the DQ lens 43 exerts maximum force 109 positively astigmatizing the beam bundle to a vertically elongate oval 110*g* which expands between the DQ lens and main lens. The main lens compressive force 111 is decreased from that of center screen causing less beam bundle compression upon exit 110*h* from the main lens 45. The oval beam bundle 110*h* emitted from the main lens 45 retains the same horizontal dimension and focal length as the beam emitted at center screen owing to the balanced horizontal forces of the DQ lens 43 and main lens 45, i.e., as DQ horizontal compressive force 115 goes up, the main lens horizontal compressive force 117 goes down. The emitted beam 13 increases in vertical dimension and focal length because the vertical force of the DQ lens and main lens are additive, i.e., as the DQ vertical diffusive force 116 goes up, expanding the beam, the main lens vertical compressive force 118 goes down, causing less beam compression. The emitted beam is thus properly astigmatized to pass through the self-converging yoke field 101 and be focused thereby to the optimal spot size 35** on the screen. Maximum positive dynamic voltage is applied to G3 upper grid so that the DQ lens potential is maximum and the main lens potential is minimum.

Figure 13:
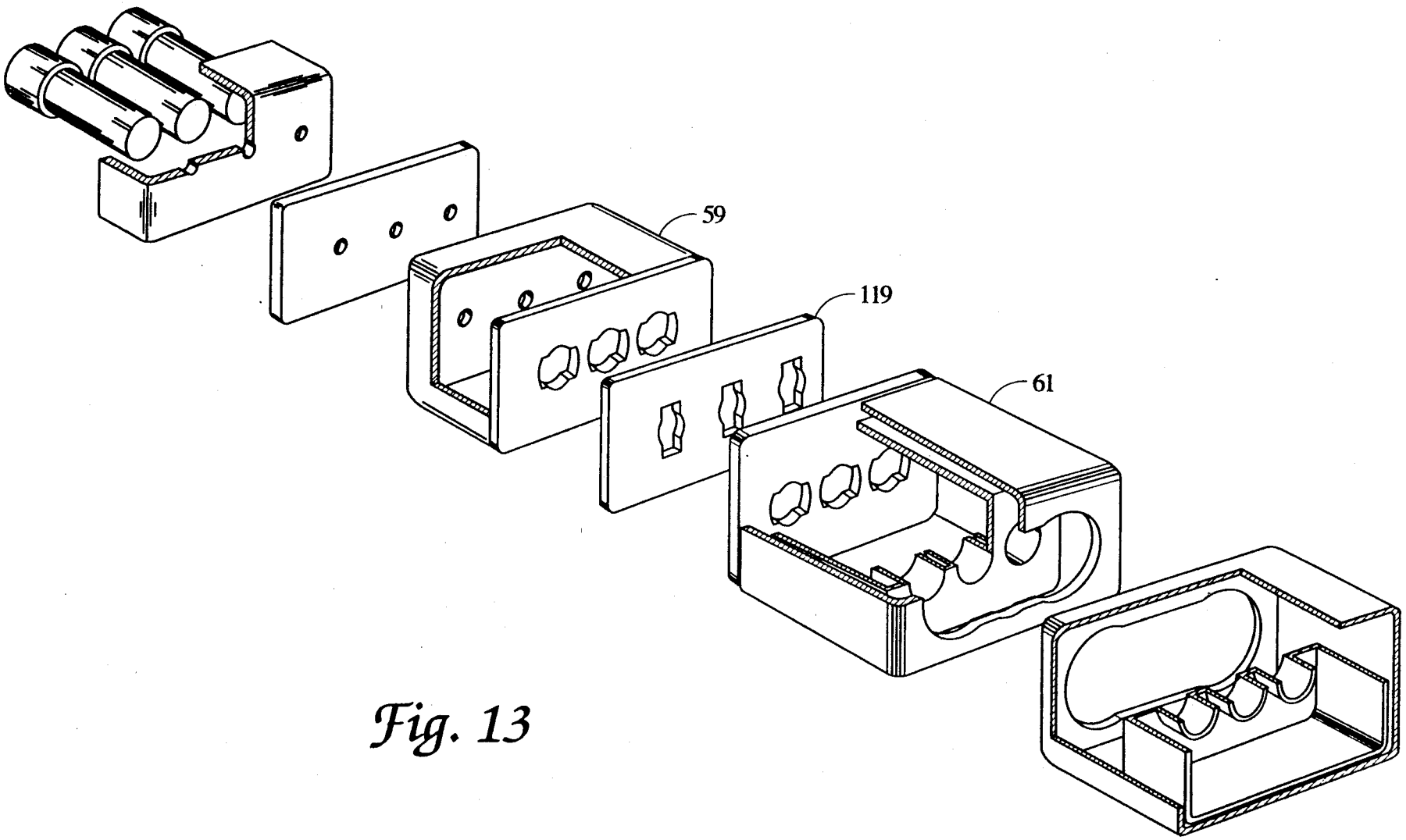
FIG. 13 is a perspective view of an alternate embodiment according to the present invention.

It will be realized that balancing of the horizontal fields may be utilized in other gun types than that described in the preferred embodiment, such as pentodes, einzels, etc., in order to achieve efficacious results. For example, an alternative to the preferred embodiment having a three plate DQ lens with the middle plate 119 receiving a fixed focus voltage and the G3 upper 61 and lower 59 barrels receiving a dynamic voltage is illustrated in FIG. 13.

It is recognized that those skilled in the art will readily perceive numerous additions and changes in the described embodiment of the invention without departing from its true spirit and scope. The invention is to be limited only as defined in the claims.

What is claimed is:

1. A three beam in-line electron gun of the type used in CRTs having self-converging yokes comprising:

a) a complimentarily-paired dynamic quadrupole lens and main lens;

b) means in the dynamic quadrupole lens for astigmatizing beams counter to a beam astigmatizing force of the self-converging yoke;

c) means in the main lens for final shaping of the beams after the beams pass through the dynamic lens, such that the beams emitted from the main lens:

1) are radially symmetrical;

2) are of like size and shape; and, 3) have a constant horizontal focal length and an increased vertical focal length as deflection of the beams increases within the CRT;

thereby allowing the beam astigmatizing force of the self-converging yoke to exert a desired focusing effect on the beams and providing an optimal beam spot across a screen of the CRT and wherein the main lens further comprises: a lower side and an upper side plate, each having expanded field apertures having three in-line interconnected beam passing apertures thereby forming an expanded field lens;

the lower plate receiving a lower voltage and having a substantially circular central aperture of lesser diameter than the outer apertures, and p1 the upper plate receiving a higher voltage and having outer circular apertures and a central rectangular channel contiguous between the circular outer apertures.

2. The electron gun according to claim 1 wherein the main lens further comprises:

a) first and second discrete-apertured plates each plate having three horizontally in-line discrete apertures;

2) the first discrete-apertured plate receiving the same voltage as the lower plate and being located upstream in the beam path therefrom the second discrete-apertured plate receiving the same voltage as the upper plate and being located downstream in the beam path therefrom and wherein the upper and lower plates and the discrete-aperture plates fulfill the dimensional relationship:

$SU \geqq SL$; $LEO > LEI$; $UEO > UEI$;

and LEO, LEI, UEO, AND UEI are all > DA where:

SU is the separation distance between the outer beam apertures formed in the upper plate, SL is the separation distance between the outer beam apertures of the lower plate and also between the outer apertures of the discrete-apertured plates.

LEO is the diameter of the outer apertures of the lower plate,

LEI is the diameter o the inner aperture of the lower plate,

UEO is the diameter of the outer apertures of the upper plate,

UEI the vertical dimension of the central channel of the upper plate,

DA is the diameter of the discrete apertures in the discrete aperture plates,

3. The electron gun according to claim 1 wherein the main lens further comprises:

a) first and second discrete-apertured plates, each plate having three horizontally in-line discrete apertures;

1) the first discrete-apertured plate receiving the same voltage as the lower plate and being located upstream i the beam path therefrom the second discrete-apertured plate receiving the same voltage as the upper plate and being located downstream in the beam path therefrom and wherein the upper and lower plates and the discrete-aperture plates fulfill the dimensional relationships:

i) $SU > SL$, and $SU + UEO \geqq SL + LEO$, to provide static convergence of the outer beams;

ii) $UEI > LEI$ and $UEO > LEO$, to provide positive astigmatism in the main lens;

iii) $LDI < LEO$, $LDO < LEO$, $UDI < UEI$, and $UDO < UEO$, to maintain all beams in like size and shape; and, iv) $LZ \approx UZ$; where:

LEO is the diameter of the outer apertures of the lower plate,

LEI is the diameter of the inner aperture of the lower plate,

UEO is the diameter of the outer apertures of the upper plate, 'UEI the vertical dimension of the central channel of the upper plate, SU is the separation distance between the outer beams apertured in the upper plate, SL is the separation distance between the outer beams aperture of the lower plate and between the outer apertures of the discrete-apertured plates, LDO is the diameter of the outer beam apertures in the first discrete-apertured plate, LDI is the diameter of the inner beam aperture in the first discrete apertured plate, UDO is the diameter of the outer beam apertures in the second discrete-apertured plate, UDI is the diameter of the inner beam aperture in the second discrete-apertured plate, LZ is the separation distance between the first discrete-apertured plate and the lower plate, and;

UZ is the separation distance between the second discrete-apertured plate and the upper plate.

4. The electron gun according to claim 1 further comprising: means for creating a positive astigmatism in electron beams emitted from the gun at a center screen position.

5. An electron gun for a color CRT, having upper and lower ends, the gu comprising in order from the lower end;

a) 1st, 2nd and 3rd horizontal in-line cathodes for emitting electrons, the 2nd cathode being centrally located, b) a control grid, G1, and a first accelerating grid, G2, for initial forming of each cathode's electron emissions into electron beams, c) a third grid, G3, having an upper and a lower barrel section;

1) the G3 lower barrel section having:

i) a lower apertured plate facing the first accelerating grid, the lower aperture plate having three discrete horizontal in-line circular apertures, and ii) a first dynamic quadrupole plate having slotted apertures facing the G3 upper barrel section;

2) the G3 upper barrel section having, i) a second dynamic quadrupole plate having slotted apertures facing the G3 lower barrel section, ii) a first discrete-apertured plate within the G3 upper barrel section, the first aperture plate having three discrete horizontal in-line circular apertures, and, iii) a "chain-like" aperture plate on the opposite end barrel from the G3 lower barrel having an expanded field aperture having opposed substantially "D"-shaped apertures for first and third beams connected by a central channel having slight, central, radiused cutouts on the channel of lower vertical height than the "D"s for forming a central aperture;

d) a fourth grid, G4, enclosing a volume and having:

1) a "dog-bone" aperture plate facing the chain-link plate, the dog-bone aperture being an expanded field aperture having outer apertures and an outline shape like a dumbbell with a straight sided central channel; and, 2) a second discrete-apertured plate within the G4 enclosure, the second discrete-apertured plate having three discrete horizontal in-line circular apertures;

wherein the elements of the gun are constructed and arranged to emit beams from the gun which are radially symmetrical, of like size and shape, and have a constant horizontal dimension and an increased vertical dimension as deflection of the beams increases within the CRT.

6. The electron gun according to claim 5 wherein the first, second, and third aperture plate apertures have peripheral collars extending axially to the electron beam path.

7. The electron gun according to claim 5 wherein the elements of the gun conform to the dimension relationship:

$$SU \geqq SL > LEO > LEI > UEO > UEI > DA;$$

where

DA is the diameter of the discrete apertures in the first and second discrete apertured plates, LEO is the diameter of the outer apertures of the chain-link expanded field aperture plate, LEI is the diameter of the inner aperture of the chain-link expanded field aperture plate, UEO is the diameter of the outer apertures of the dog-bone expanded field aperture plate, UEI is the vertical dimension of the central channel of the dog-bone expanded field aperture plate, SU is the separation distance between the outer apertures formed by the dog-bone expanded field aperture plate, SL is the separation distance between the outer apertures of the chain-link expanded field aperture plate and between the apertures of the discrete-apertured plates.

8. The electron gun according to claim 5 further comprising: a third dynamic quadrupole plate interposed between the first and second dynamic quadrupole plates.

9. The electron gun according to claim 8 wherein: the third dynamic quadrupole plate has slotted apertures, whose long axis are in the vertical direction.

10. The electron gun according to claim 5 wherein the G1 and G2 aperture diameters are fourteen and eighteen mils respectively.

11. The electron gun according to claim 5 wherein the cathodes are of the dispenser type.

12. The electron gun according to claim 5 wherein the first dynamic quadrupole plate has slotted apertures whose long axes are in the vertical direction.

13. The electron gun according to claim 5 wherein the second dynamic quadrupole plate has slotted apertures whose long axes are in the horizontal direction.

* * * * *